US008177257B2

(12) United States Patent
Dugas et al.

(10) Patent No.: US 8,177,257 B2
(45) Date of Patent: May 15, 2012

(54) WHEELCHAIR BASE

(76) Inventors: Eric Dugas, Quebec (CA); Carmon Landry, Quebec (CA)

( * ) Notice: Subject to any disclaimer, the term of this patent is extended or adjusted under 35 U.S.C. 154(b) by 291 days.

(21) Appl. No.: 12/599,182

(22) PCT Filed: May 8, 2008

(86) PCT No.: PCT/CA2008/000899

§ 371 (c)(1),
(2), (4) Date: Nov. 6, 2009

(87) PCT Pub. No.: WO2008/134898

PCT Pub. Date: Nov. 13, 2008

(65) Prior Publication Data

US 2010/0301576 A1 Dec. 2, 2010

(30) Foreign Application Priority Data

May 8, 2007 (GB) ..... 0708834.7

(51) Int. Cl.
*A61G 5/54* (2006.01)

(52) U.S. Cl. ..... 280/755; 180/907; 180/908

(58) Field of Classification Search ..... 280/755, 280/250.1, 304.1, 47.16; 180/907, 908
See application file for complete search history.

(56) References Cited

U.S. PATENT DOCUMENTS

| | | | | |
|---|---|---|---|---|
| 4,128,137 | A | 12/1978 | Booth | |
| 5,964,473 | A * | 10/1999 | Degonda et al. | 280/250.1 |
| 6,070,898 | A | 6/2000 | Dickie et al. | |
| 6,073,951 | A | 6/2000 | Jindra et al. | |
| 6,129,165 | A | 10/2000 | Schaffner et al. | |
| 6,234,507 | B1 * | 5/2001 | Dickie et al. | 280/304.1 |
| 6,460,641 | B1 | 10/2002 | Kral | |
| 6,923,278 | B2 | 8/2005 | Mulhern et al. | |
| 7,021,641 | B2 | 4/2006 | Wu | |
| 7,040,429 | B2 * | 5/2006 | Molnar | 180/65.1 |
| 7,083,195 | B2 * | 8/2006 | Goertzen et al. | 280/755 |
| 7,234,554 | B2 * | 6/2007 | Mulhern et al. | 180/65.6 |
| 7,264,272 | B2 * | 9/2007 | Mulhern et al. | 280/755 |
| 7,273,118 | B2 * | 9/2007 | Huang | 180/65.1 |
| 7,293,801 | B2 * | 11/2007 | Bertrand et al. | 280/755 |
| 7,314,220 | B2 * | 1/2008 | Turturiello et al. | 280/5.5 |
| 7,316,282 | B2 * | 1/2008 | Mulhern et al. | 180/65.1 |
| 7,389,835 | B2 * | 6/2008 | Mulhern et al. | 180/22 |
| 7,413,038 | B2 * | 8/2008 | Mulhern et al. | 180/22 |
| 7,516,984 | B2 * | 4/2009 | Tang | 280/755 |
| 7,726,689 | B2 * | 6/2010 | Mulhern et al. | 280/755 |
| 7,896,394 | B2 * | 3/2011 | Jackson et al. | 280/755 |
| 7,931,300 | B2 * | 4/2011 | Mulhern et al. | 280/755 |
| 8,037,953 | B2 * | 10/2011 | Puskar-Pasewicz et al. | 180/65.1 |
| 2006/0249317 | A1 | 11/2006 | Fought | |

FOREIGN PATENT DOCUMENTS

| | | | |
|---|---|---|---|
| EP | 1522294 | A2 | 4/2005 |
| EP | 1522294 | A3 | 6/2005 |
| EP | 1767178 | A1 | 3/2007 |
| WO | 03030800 | A1 | 4/2003 |

* cited by examiner

*Primary Examiner* — Drew Brown

(57) ABSTRACT

A wheelchair base including a base frame and a pair of pivot arm assemblies each including a first pivot arm and a second pivot arm, pivotally coupled to each other for pivotal movement about a transverse pivot axis. The pivot arms defining first and second auxiliary wheel attachments opposed to the transverse pivot axis for attaching first and second end auxiliary wheels. Each pivot arm assembly including a link pivotally coupled to the second pivot arm intermediate the transverse pivot axis and the second auxiliary wheel attachment for pivotal movement about a link axis substantially parallel to the transverse pivot axis forming a drive wheel attachment intermediate the auxiliary wheel attachments. The pivot arm assemblies are mounted to the base frame substantially laterally opposed to each other through the link and first pivot arm such that the pivot arm assemblies are independently pivotable relative to the base frame.

16 Claims, 5 Drawing Sheets

WHEELCHAIR BASE

FIELD OF THE INVENTION

The present invention relates generally to wheelchairs and, more particularly, to a wheelchair base, such as a motorized base for a mid-wheel power drive wheelchair.

BACKGROUND OF THE INVENTION

Mid-wheel power drive wheelchairs are known in the art and generally consist of a motorized base supporting a seat assembly. The motorized base generally comprises a central base frame equipped with a pair of drive wheels that are approximately positioned below the center of gravity of the vehicle when loaded with a user, a pair of front casters and a pair of rear, anti-tip casters, which prevent rearward tipping of the wheelchair. The pair of drive wheels are typically powered by individual compact electric motor and gearbox assemblies directly coupled to the inner side of each drive wheel, and a power battery conveniently tucked in a battery compartment generally occupying a central position between the drive wheels, just underlying the seat assembly.

The motorized base further comprises a support structure that interfaces the casters and drive wheels, including the motor and gearbox assemblies, with the rest of the wheelchair, namely the base frame, battery compartment and seat assembly. Typically, the support structure may represent a rigid support frame directly coupling the drive wheels and casters to the wheelchair, or a suspension system offering resilient suspension means between some or all of the wheels, and the rest of the wheelchair, thus allowing some degree of comfort to the user while traveling over an uneven or irregular ground surface. Typical examples of the prior art are U.S. Pat. No. 7,021,641B2, to Wu (2006), U.S. Pat. No. 6,073,951, to Jindra et al. (2000), U.S. Pat. No. 6,923,278B2, to Mulhern et al. (2005), and U.S. Pat. No. 6,070,898, to Dickie et al. (2000). The more complex support structures may further include pivotable front casters and drive wheels assemblies that allow a user to overcome abrupt obstacles such as a protuberant door step or the side edge of a sidewalk. In this regard, typical examples of the prior art are Pat. No. 2006/0249317A1, to Fought (2006), Pat. No. WO03/030800A1, to Molnar (2003), and Pat. No. EP1767178A1, to Hsu (2007).

While these motorized bases of the prior art can generally fulfill the main objective of enhancing the comfort of a user traveling aboard a powered wheelchair, they also offer one or more of the following disadvantages:

a) the generally limited flexibility of the suspension systems integrated in motorized bases of the prior art, particularly the suspension systems comprising resilient material such as rubber, instead of dynamic suspension strut, often result in a wheelchair experiencing uneven distribution of weight among its casters and drive wheels when engaging on an uneven or undulated ground surface. In some situations, one or more of the casters or drive wheels loose contact with the ground, thus resulting in a wheelchair having reduced stability;

b) moreover, while most motorized bases incorporates some form of suspension means applied to the front casters and/or drive wheels, the rear or anti-tip casters are generally rigidly attached to the rear end of the base frame and, thus, any small projections or irregularities encountered on the ground surface are directly transmitted to the seat and backrest assembly, adding to the discomfort of the user;

c) motorized bases equipped with pivotabie front casters and drive wheel assemblies may prove hazardous to use, particularly on an uneven or undulated ground surface since one or both front casters may inadvertently leave the ground due to a forced acceleration applied during a climbing operation;

d) generally, the inherent structure of the motorized bases does not allow for the custom positioning of the seat assembly and/or the battery compartment along the longitudinal axis of the central base frame, thus constraining the user to adopt a fixed position over a predefined center of gravity of the wheelchair.

Against this background, there exist a need for a new and improved wheelchair base. It is a general object of the present invention to provide a new and improved wheelchair base.

SUMMARY OF THE INVENTION

In a broad aspect, the invention provides a wheelchair base, said wheelchair base being usable with first and second drive wheels, first end first and second auxiliary wheels and second end first and second auxiliary wheels, said wheelchair base comprising:

a base frame;

a first pivot arm assembly, said first pivot arm assembly including a first assembly first pivot arm and a first assembly second pivot arm, said first assembly first and second pivot arms being pivotally coupled to each other for pivotal movement about a first assembly transverse pivot axis, said first assembly first and second pivot arms defining respectively first assembly first and second auxiliary wheel attachments substantially opposed to said first assembly transverse pivot axis for attaching respectively said first and second end first auxiliary wheels thereto, said first pivot arm assembly further including a first assembly link pivotally coupled to said first assembly second pivot arm at a location intermediate said first assembly transverse pivot axis and said first assembly second auxiliary wheel attachment for pivotal movement about a first assembly link axis substantially parallel to said first assembly transverse pivot axis, said first pivot arm assembly further defining a first drive wheel attachment at a location intermediate said first assembly first and second auxiliary wheel attachments for attaching said first drive wheel thereto;

a second pivot arm assembly, said second pivot arm assembly including a second assembly first pivot arm and a second assembly second pivot arm, said second assembly first and second pivot arms being pivotally coupled to each other for pivotal movement about a second assembly transverse pivot axis, said second assembly first and second pivot arms defining respectively second assembly first and second auxiliary wheel attachments substantially opposed to said second assembly transverse pivot axis for attaching respectively said first and second end second auxiliary wheels thereto, said second pivot arm assembly further including a second assembly link pivotally coupled to said second assembly second pivot arm at a location intermediate said second assembly transverse pivot axis and said second assembly second auxiliary wheel attachment for pivotal movement about a second assembly link axis substantially parallel to said second assembly transverse pivot axis, said second pivot arm assembly further defining a second drive wheel attachment at a location intermediate said second assembly first and second auxiliary wheel attachments for attaching said second drive wheel thereto;

said first and second pivot arm assemblies being mounted to said base frame substantially laterally opposed to each other with said first and second assembly transverse pivot axes substantially parallel to each other; said first and second assembly first pivot arms pivotally coupled to said base frame for pivotal movement respectively about a first and a second assembly first arm axis, said first and second assembly first arm axes being substantially parallel to said first assembly transverse pivot axis; and said first and second assembly links pivotally coupled to said base frame for pivotal movement respectively about a first and a second assembly link-to-frame axis, said first and second assembly link-to-frame axes being substantially parallel to said first assembly transverse pivot axis;

said first pivot arm assembly being pivotable relative to said base frame independently of said second pivot arm assembly.

Advantageously, the proposed wheelchair base allows for manufacturing a wheelchair in which the four auxiliary wheels and the two drive wheels can simultaneously remain in contact with the ground while travelling, even if the ground includes relatively large irregularities. This is due, in part, by the ability of the first and second pivot arm assemblies to pivot independently of each other relative to the base frame. This in turn greatly increases the stability of the wheelchair, which is particularly advantageous in the case of motorized wheelchairs that are often used by intended users having restricted strength, and which, therefore, cannot use their strength to stabilize the wheelchair should any wheel get out of contact with the ground.

According to an embodiment of the present invention, the wheelchair base generally comprises a generally horizontal rectangular base frame to which is adjustably attached an underlying battery compartment and, on top of which, there may be adjustably attached a seat assembly, a stretcher, or the like.

The base frame is pivotably coupled, on opposite lateral sides of the latter, to the first and second pivot arm assemblies. Each of the first and second pivot arm assemblies is independently pivotably coupled, near its distal end, to the base frame for pivotal movement respectively about the first and a second assembly first arm axes, and indirectly about the first and a second assembly link-to-frame axes parallel to the rear end member of the base frame through the first and second assembly links.

Each pivot arm assembly is further equipped with a mid-wheel power drive assembly, generally consisting of a drive wheel directly coupled to a compact electric motor and gearbox assembly.

Some of the main advantages of the present invention are to provide a wheelchair base:

a) which may be used to travel over uneven or undulated ground surfaces, with each of its wheels maintaining permanent contact with the ground, as well as supporting an evenly distributed load;

b) whose auxiliary and drive wheels, being all mounted on pivot arms relative to the base frame, substantially dampen irregularities and vibrations encountered on the ground surface that are communicated to the base frame supporting the seat assembly and, thus, provide a more comfortable ride to the user of the wheelchair;

c) whose base frame allows for independent positioning of the seat assembly and battery compartment relative to the longitudinal axis of the motorized base, thus allowing a user to adjust the seat assembly to a preferred longitudinal position relative to the motorized base, while still preserving the overall center of gravity of the wheelchair generally above the drive wheels through the independent adjustment of the battery compartment;

d) which is quite simple and inexpensive in construction, and yet which is quite efficient and reliable in operation.

In another broad aspect, the invention provides a wheelchair, said wheelchair comprising:

a base frame;

a first pivot arm assembly, said first pivot arm assembly including a first assembly first pivot arm and a first assembly second pivot arm, said first assembly first and second pivot arms being pivotally coupled to each other for pivotal movement about a first assembly transverse pivot axis;

first and second end first auxiliary wheels mounted respectively to said first assembly first and second pivot arms substantially opposed to said first assembly transverse pivot axis, said first pivot arm assembly further including a first assembly link pivotally coupled to said first assembly second pivot arm at a location intermediate said first assembly transverse pivot axis and said second end first auxiliary wheel for pivotal movement about a first assembly link axis substantially parallel to said first assembly transverse pivot axis;

a first drive wheel mounted to said first pivot arm assembly at a location intermediate said first and second end first auxiliary wheels;

a second pivot arm assembly, said second pivot arm assembly including a second assembly first pivot arm and a second assembly second pivot arm, said second assembly first and second pivot arms being pivotally coupled to each other for pivotal movement about a second assembly transverse pivot axis;

first and second end second auxiliary wheels mounted respectively to said second assembly first and second pivot arms substantially opposed to said second assembly transverse pivot axis, said second pivot arm assembly further including a second assembly link pivotally coupled to said second assembly second pivot arm at a location intermediate said second assembly transverse pivot axis and said second end second auxiliary wheel for pivotal movement about a second assembly link axis substantially parallel to said second assembly transverse pivot axis;

a second drive wheel mounted to said second pivot arm assembly at a location intermediate said first and second end second auxiliary wheels;

said first and second pivot arm assemblies being mounted to said base frame substantially laterally opposed to each other with said first and second assembly transverse pivot axes substantially parallel to each other; said first and second assembly first pivot arms pivotally coupled to said frame for pivotal movement respectively about a first and a second assembly first arm axis, said first and second assembly first arm axes being substantially parallel to said first assembly transverse pivot axis; and said first and second assembly links pivotally coupled to said frame for pivotal movement respectively about a first and a second assembly link-to-frame axis, said first and second assembly link-to-frame axes being substantially parallel to said first assembly transverse pivot axis;

said first pivot arm assembly being pivotable relative to said base frame independently of said second pivot arm assembly.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings, in which.

DETAILED DESCRIPTION

Figure 1:
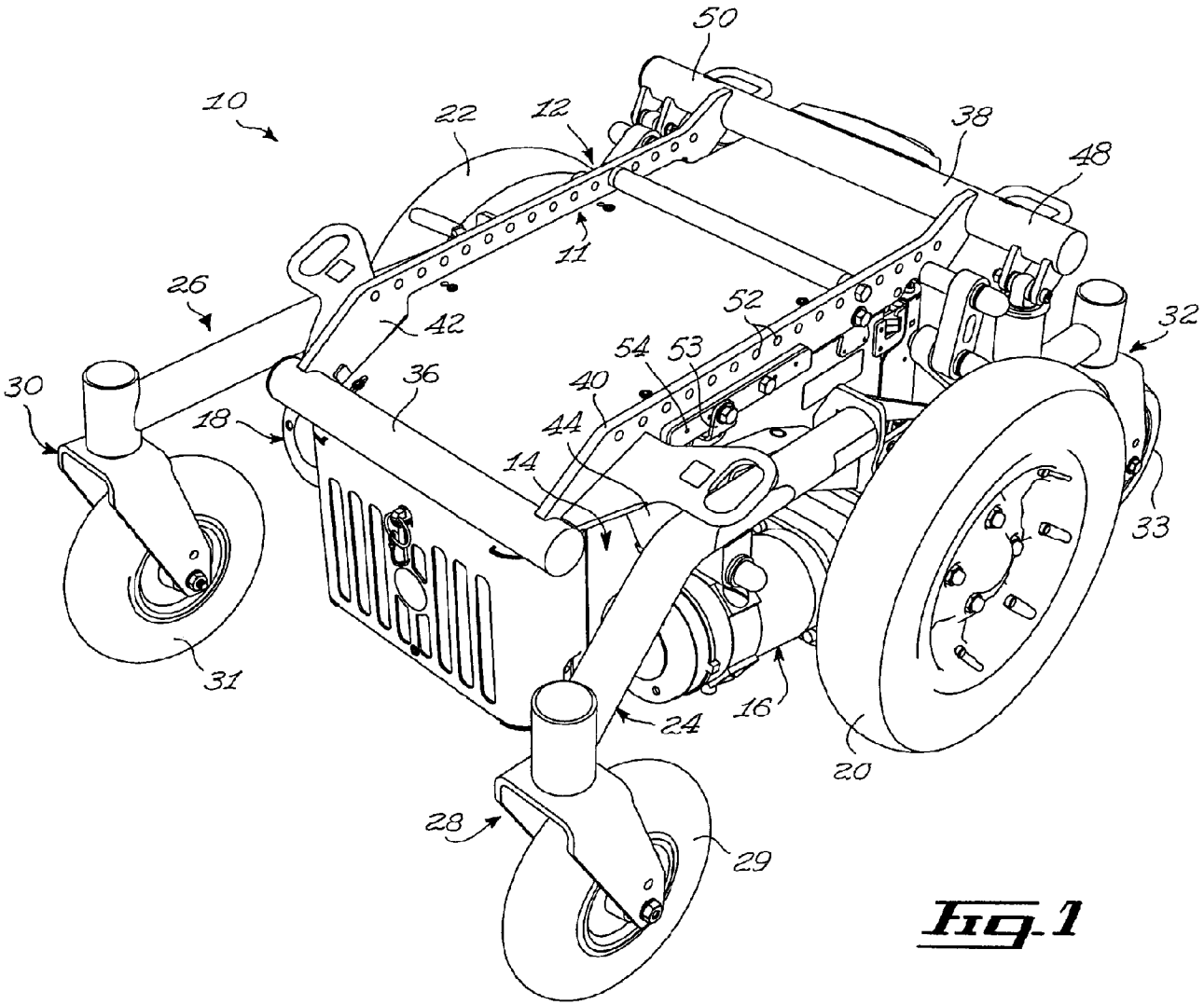
FIG. 1, in a perspective view, illustrates a wheelchair base in accordance with an embodiment of the present invention.

FIGS. 1 to 4 show various aspects of an embodiment of a wheelchair base 10 in accordance with an embodiment of the present invention. For example, the wheelchair base 10 is a base for a mid-wheel power drive wheelchair. Referring to FIG. 1, the wheelchair base 10 generally comprises a chassis 12, a battery compartment 14, two mid-wheel power drive assemblies 16 and 18, to which respectively first and second drive wheels 20 and 22 are mounted, first and second pivot arm assemblies 24 and 26, front caster assemblies 28 and 30 including respectively front end first and second wheels 29 and 31, and rear caster assemblies 32 and 34 including respectively rear end first and second wheels 33 and 35, only one of which is seen in FIG. 1.

The reader skilled in the art will readily appreciate that the terminology "front" and "rear" is used to facilitate the description of the wheelchair base 10 and should not be used to restrict the scope of the invention. Indeed, some usable embodiments of the proposed wheelchair base are usable with the "front" and "rear" ends thereof reversed with respect to the embodiment described in the present document.

Chassis 12 is generally represented by a generally rectangular planar base frame 11 defined by parallel and substantially tubular front end cross-member 36 and rear end cross-member 38 joined by oppositely disposed elongated substantially S-shaped flat bar members 40 and 42.

Axially parallel with, and projecting substantially adjacent the front end cross-member 36, are a pair of pivot support means, only one of which is seen on FIG. 1, namely pivot support means 44 is either formed or rigidly attached near each opposite ends of the front end cross-member 36. In a similar fashion, axially parallel with, and projecting rearwardly from rear end cross-member 38, are a pair of pivot support means 48 and 50 positioned near opposite ends of the latter. As it will be described in more details hereinafter, pivot support means 44, 48 and 50, thus generally positioned at each corner of chassis 12, are for pivotably coupling the latter to the first and second pivot arm assemblies 24 and 26.

S-shaped flat bar members 40 and 42 are provided with a pair of horizontal sets of adjustment holes 52 and 54 that are longitudinally disposed along each members. The upper horizontal set of adjustment holes 52 provides a plurality of equidistant holes for allowing the attachment and longitudinal positioning of a seat assembly 55, seen in FIG. 4. The lower set of adjustment holes 54 provides a plurality of adjustment holes 54 for allowing the attachment and longitudinal positioning of battery compartment 14 through a plurality of attachment ears 53 projecting upwardly from the corresponding lateral upper edges of the battery compartment 14, which can be affixed to chassis 12 using any suitable attachment means such as, for example, thumb screws, lock pins or the like.

Figure 2:
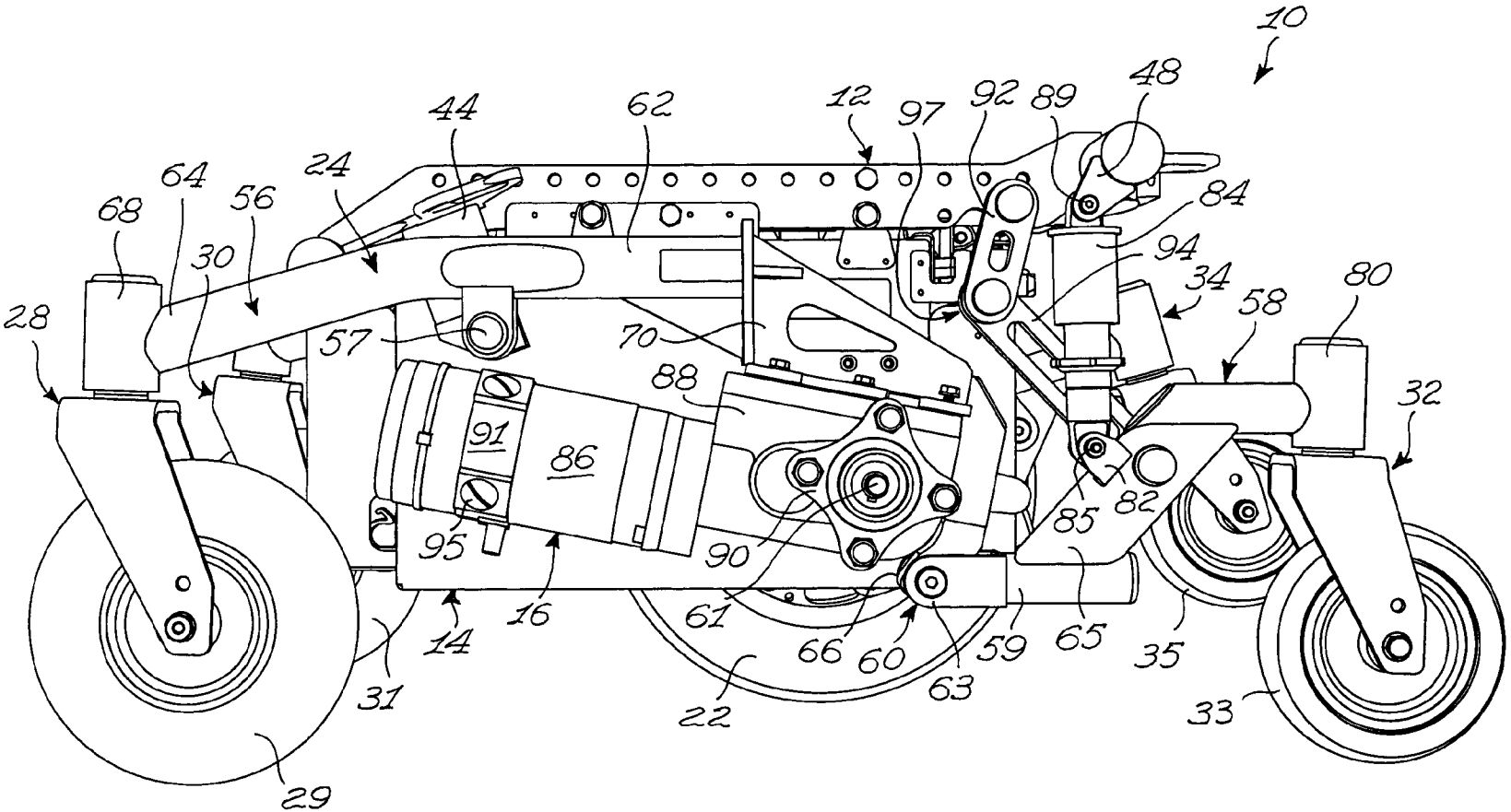
FIG. 2, in a side elevation view with parts removed, illustrates the wheelchair base shown in FIG. 1.
Figure 3:
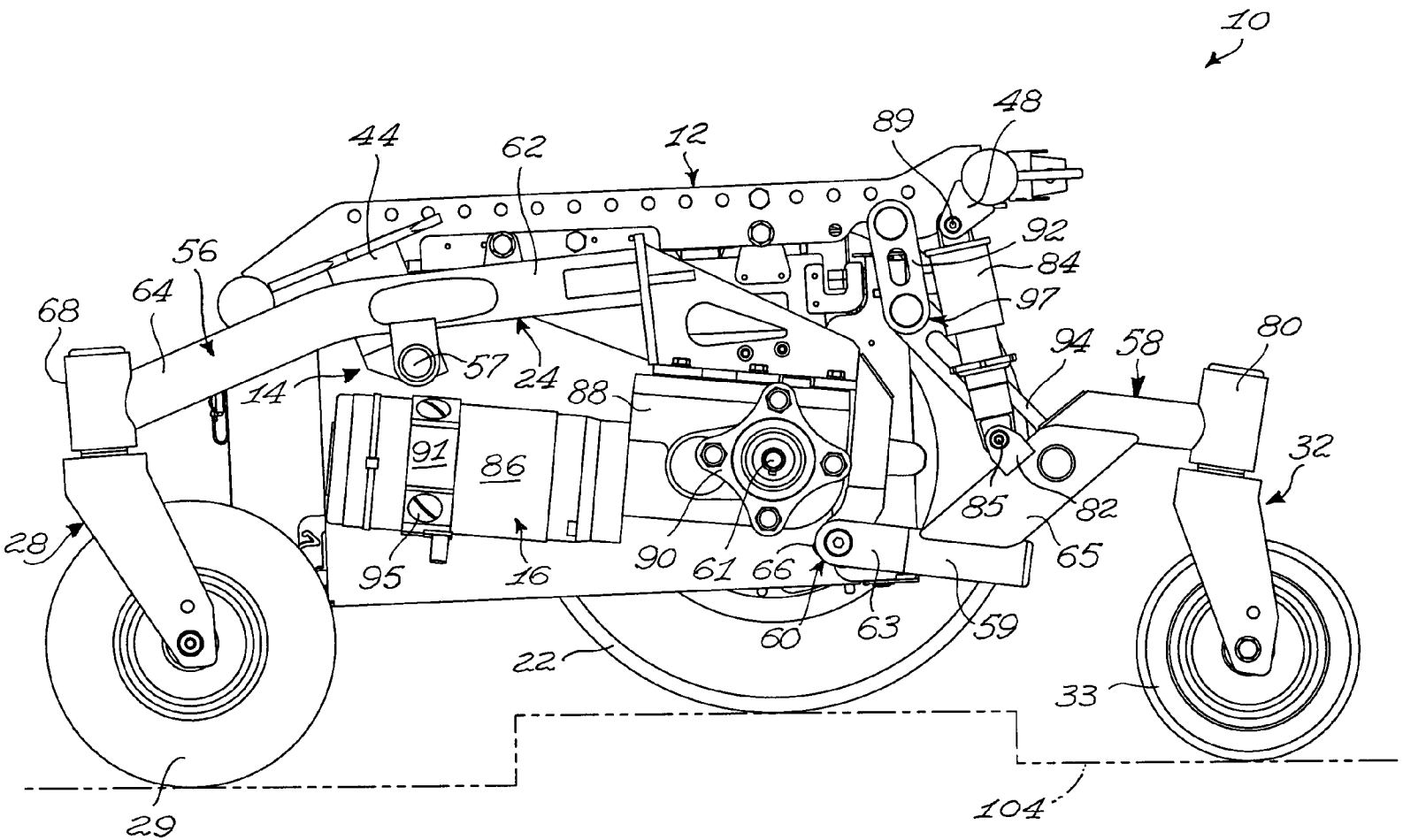
FIG. 3, in a side elevation view, illustrates the wheelchair base shown in FIG. 1, the wheelchair base being shown attached to a mid-drive wheel, on opposite side of view, mounted on a ground elevation.
Figure 4:
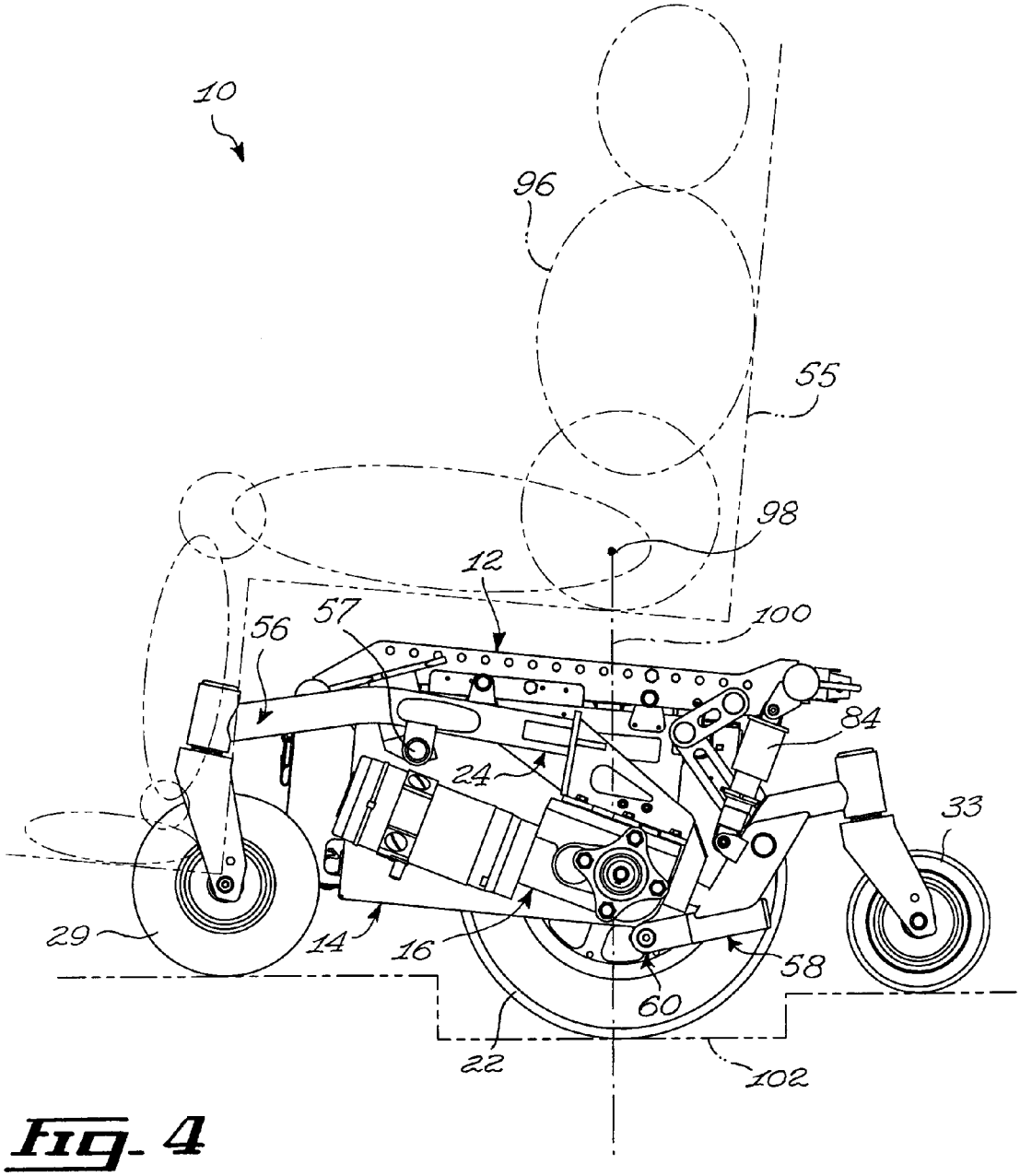
FIG. 4, in a side elevation view, illustrates the wheelchair base shown in FIG. 1, the wheelchair base being shown attached to a mid-drive wheel, on opposite side of view, lowered in a ground depression, the wheelchair base being shown with a seat assembly attached thereto and an intended user sitting on the seat assembly, both shown in phantom lines.

FIGS. 2-4 better illustrate the first pivot arm assembly 24, which generally comprises a first assembly first pivot arm, which will be referred to hereinbelow as a front pivot arm 56, and a first assembly second pivot arm, which will be referred to hereinbelow as a rear pivot arm 58. The front and rear pivot arms 56 and 58 are pivotably coupled to one another through pivot interface 60 for pivotal movement about a first assembly transverse pivot axis 61. The second pivot arm assembly 26 is substantially similar to the first pivot arm assembly 24 and is therefore not described in further details herein.

Front pivot arm 56 is generally defined by an elongated member having an essentially L-shaped proximal end section 62 and an angled, distal end section 64. Proximal end section 62 is terminated with a pivot support means 66, while angled distal end section 64 is terminated with a swivel assembly 68 that interfaces with front caster assembly 28. Roughly positioned adjacent the pivot support means 66 there is provided a drive support means 70 for attaching thereto the mid-wheel power drive assembly 16.

Rear pivot arm 58 generally defines a elongated member having an S-shaped configuration with proximal end 59 terminated with a pivot support means 63 cooperatively coupled with opposite pivot support means 66, and angled distal end section 65 terminated with a swivel assembly 80 to which the rear caster assembly 32 is attached. Thus, pivot support means 66 and 63 allow front and rear pivot arms 56 and 58 to revolve in a vertical plane about the first assembly transverse pivot axis 61, which extends generally horizontally when the wheelchair base 10 is in use. The swivel assemblies 68 and 80 form first assembly first and second auxiliary wheel attachments substantially opposed to the first assembly transverse pivot axis 61 and are provided for attaching respectively front and rear end first auxiliary wheels 29 and 33 thereto.

Positioned on the angled distal end section 65 on rear pivot arm 58, there is provided a pivot support means 82 for pivotably coupling the rear pivot arm 58 with a first assembly link, referred to hereinbelow as a pivot link 84 which, in turn, is pivotably coupled to pivot support means 48 on the rear end cross-member 38 of chassis 12. The pivot link 84 is therefore pivotally coupled to the rear pivot arm 58 at a location intermediate the first assembly transverse pivot axis 61 and the first assembly second auxiliary wheel attachment, namely the swivel assembly 80, for pivotal movement about a first assembly link axis 85 substantially parallel to the first assembly transverse pivot axis 61.

The first and second pivot arm assemblies 24 and 26 are mounted to the base frame 11 substantially laterally opposed to each other so that their transverse pivot axes are substantially parallel to each other. For example, regarding the first pivot arm assembly, the front pivot arm 56 is pivotally coupled to the base frame 11, and more specifically to the pivot support means 44 for pivotal movement about a first assembly first arm axis 57, the first assembly first arm axis 57 being substantially parallel to the first assembly transverse pivot axis 61. Finally, the pivot link 84 is pivotally coupled to the base frame 11 for pivotal movement about a first assembly link-to-frame axis 89, the first assembly link-to-frame axis 89 being substantially parallel to the first assembly transverse pivot axis 61. The proposed configuration of the wheelchair base 10 is such that the first pivot arm assembly 24 is pivotable relative to the base frame 11 independently of the second pivot arm assembly 26.

FIGS. 2 to 4 further show the mid-wheel power drive assembly 16 that is attached to the front pivot arm 56 and which includes a first drive wheel attachment in the form of a drive axle 90 at a location intermediate the first assembly first and second auxiliary wheel attachments for attaching the first drive wheel 20, not show in FIGS. 2 to 4, thereto. The power drive assembly 16 generally comprises a drive motor 86 longitudinally coupled to a gearbox unit 88 which, in turn, is coupled to the first drive wheel (not shown in FIGS. 2 to 4) through the laterally extending drive axle 90. An elongated mounting bracket 91 having a substantially U-shaped cross-section longitudinally cover the upper portion of, and is rigidly attached to drive motor 86 and gearbox unit 88 assembly using any appropriate means such as, for example, screws 95, or the like. Mid-wheel power drive assembly 18, on opposite side of the wheelchair base 10, is of similar construction.

In some embodiments of the invention, the pivot link 84 includes a suspension element for allowing variations in the pivot link length. Typically, the suspension element is configured for biasing the pivot link 84 towards an equilibrium length. An example of a suitable suspension element is a McPherson style suspension strut, which constitutes the pivot link 84. The McPherson style suspension strut is preferably calibrated to offer a comfortable ride to a user having an average weight, combined with the suspended weight of the power drive wheelchair.

In some embodiments of the invention, as better seen in FIG. 2, the first pivot arm assembly 24 further includes a first assembly reinforcing element 97 operatively coupled to the rear pivot arm 58 and to the base frame 11 for allowing pivotal movements of the pivot link 84 relative to the rear pivot arm 58 and to the base frame 11. The first assembly reinforcing element 97 includes a reinforcing element first member 92 pivotally coupled to the base frame 11 and a reinforcing element second member 94 pivotally coupled to the rear pivot arm 58 and to the reinforcing element first member 92. The first assembly reinforcing element 97 and the pivot link 84 are pivotally coupled to the base frame 11 and to the rear pivot arm 58 at locations that are spaced apart from each other. In other words, the locations at which the pivot link 84 and the first assembly reinforcing element 97 attach to the base frame 11 and the rear pivot arm 58 form a quadrilateral. This improves the rigidity of the wheelchair base 10 by resisting rotational motions of the first pivot arm assembly 24 about a substantially vertical axis. The second pivot arm assembly 26 is substantially similar to the first pivot arm assembly 24.

As seen in FIG. 4, the wheelchair base 10 is usable with a seat assembly 55 mounted to the base frame 11 by an intended user 96 sitting on the seat assembly 55. The seat assembly 55 and the intended user together defines a center of gravity 98, the center of gravity 98 defining a center of gravity projection axis 100 projecting substantially downwardly from the center of gravity 98. The first link-to-frame axis 89 is substantially closer to the center of gravity projection axis 100 than the first assembly first arm axis 57. This configuration positions the pivot link 84, and therefore the suspension element, at a location that improves comfort of the intended user 96. Also, in embodiments in which the rear pivot arm 58 is positioned rearwardly relative to the front pivot arm 56, the pivot link 84 is positioned optimally to reduce transmission to the back of the intended user, which is typically firmly coupled to the seat assembly 55, of vibrations and shocks experienced when the wheelchair assembly 10 moves onto ground.

It can be readily observed that pivot interfaces 60 of the first pivot arm assembly 24 may be raised or lowered relative to the pivot support means 44 and 48 coupled to chassis 12 and, in turn, drive wheel 20 may be raised or lowered relative to pivot interface 60.

For example, when wheelchair base 10 is standing still or is travelling on a substantially planar ground surface, the corresponding proximal ends of front pivot arm 56 and rear pivot arm 58 are substantially axially aligned relative to one another, as best illustrated in FIG. 2. The result is a mid-wheel power drive wheelchair having chassis 12 generally preserved in a co-planar position relative to the ground surface, with the weight of the wheelchair evenly distributed among its six wheels 20, 22, 29, 31, 33 and 35.

When wheelchair base 10 is standing still or is travelling on an uneven or irregular ground surface, the various pivotal mountings of the system may be individually or concurrently solicited due to a differential elevation between two or more of the six wheels 20, 22, 29, 31, 33 and 35 of the motorized base, while still preserving all six wheels 20, 22, 29, 31, 33 and 35 in contact with the ground. Under such conditions, chassis 12 is generally maintained in a co-planar position relative to an average ground level, with the weight of the wheelchair being evenly distributed on its six wheels 20, 22, 29, 31, 33 and 35.

For example, FIG. 4 show wheelchair base 10 having the first drive wheel 20 (not seen in FIG. 4 for clarity purposes) and the second drive wheel 22 lowered in a ground depression 102, thus forcing proximal ends 59 and 62 of first pivot arm assembly 24 into a substantially V-shaped configuration, with all six wheels 20, 22, 29, 31, 33 and 35 of wheelchair base 10 maintained in contact with the ground surface. Thus, it can be readily observed that pivot interface 60 of the first pivot arm assembly 24 may be raised or lowered relative to the pivot support means 44 and 48 coupled to chassis 12, and that first drive wheel 20, in turn, be raised or lowered with pivot interface 60. The second drive wheel 22 and the second pivot arm assembly 26 are capable of similar movements.

In a similar fashion, FIG. 3 shows, in a reduced scale, wheelchair base 10 having the second drive wheel 22 raised on top of a ground elevation 104, thus an opposite movement of the second pivot arm assembly 26, here again, all six wheels 20, 22, 29, 31, 33 and 35 maintained in contact with the ground surface.

It is to be noted that the pivot link 84 need not include a suspension element in some embodiments of the invention and that this suspension element is not necessarily solicited during dynamic articulations of the first pivot arm assembly 24 since its objective is mainly to absorb vibrations and sudden jolts caused by irregularities encountered by drive wheel 20 along the travel surface.

In the wheelchair base 10, the drive motor 86 is attached to the front pivot arm 56 and positioned forwardly of the first drive wheel 20. This configuration that the front end first auxiliary wheel 29 be positioned relatively far from the first drive wheel 20 so that the drive motor 86 can be attached between the first drive wheel 20 and the front end first auxiliary wheel 29. This increases the stability of the wheelchair base 10.

Figure 5:
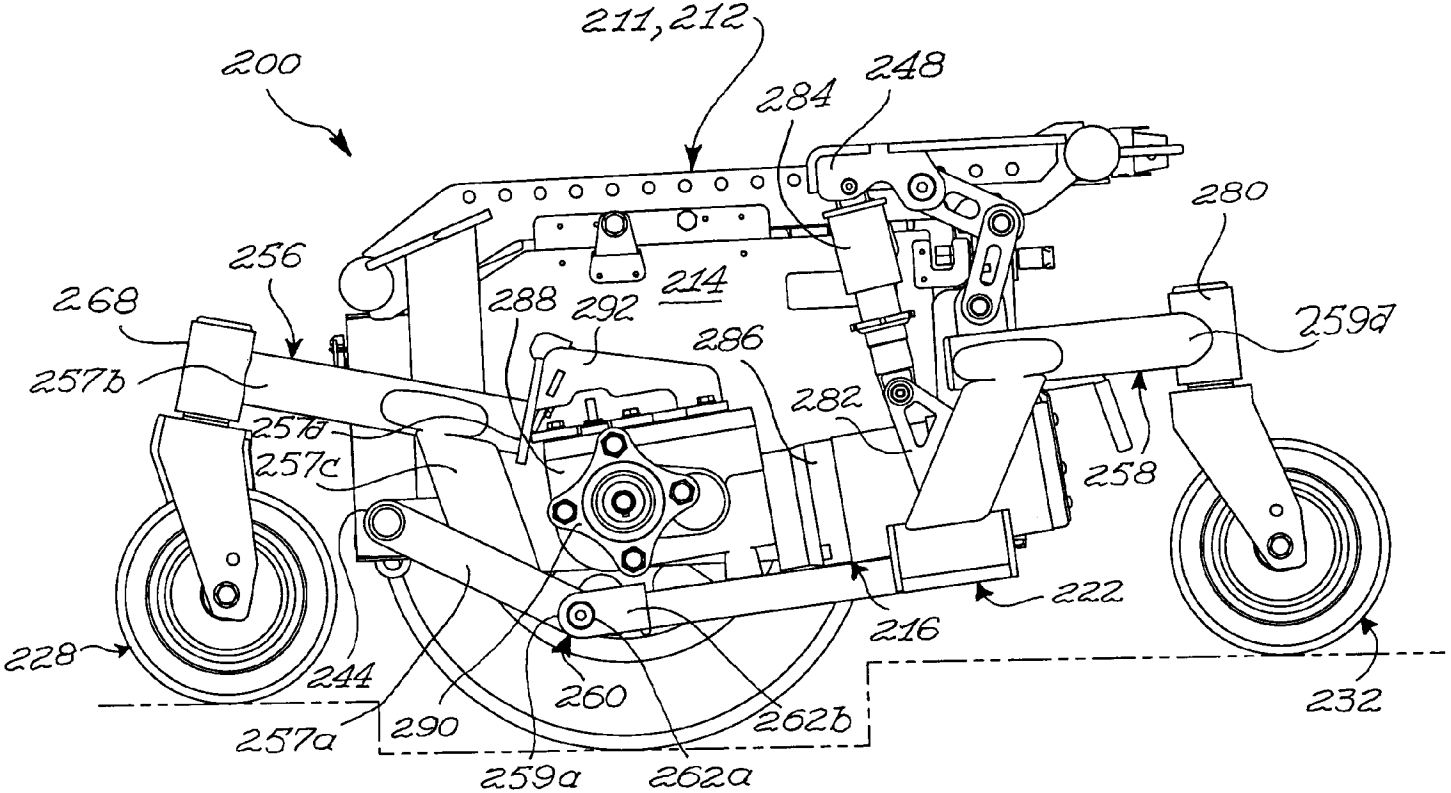
FIG. 5, in a side elevation view, illustrates a wheelchair base in accordance with an alternative embodiment of the invention, the wheelchair base being shown attached to a mid-drive wheel, on opposite side of view, lowered in a ground depression.

FIG. 5 illustrates an alternate embodiment 200 of the wheelchair base that is substantially similar to the wheelchair base 10, except for the configuration of the front and rear pivot arms 256 and 258 and the fact that the drive motor 86 is attached to the rear pivot arm 258, which allows for manufacturing a shorter front pivot arm 256 to increase the maneuverability of the wheelchair base 200. Similarly to the first embodiment 10 described above, the wheelchair base 200 generally consists of a chassis 212, a battery compartment 214, mid-wheel power drive assembly 216 and first pivot arm assembly 222 provided with front and rear caster assemblies 228 and 232 respectively.

Chassis 212 and battery compartment 214 are substantially equivalent to the ones in the first embodiment described above. The chassis 212 defines a base frame 211. Also, a second pivot arm assembly (not seen in FIG. 5) substantially similar to the first pivot arm assembly 222 is provided. The first pivot arm assembly 222 includes a front pivot arm 256 and a rear pivot arm 258 pivotably coupled to one another through pivot interface 260. In this particular embodiment, front pivot arm 256 has a substantially angular S-shaped configuration formed by a pair of elongated members 257*a* and 257*b* joined together through a cross-plate 257*c*. Lower elongated member 257*a* is terminated with a pivot support means 262*a* while upper elongated member 257*b* is terminated with a swivel assembly 268 that interfaces with front caster assembly 228. Rear pivot arm 258 generally defines a elongated member having a relatively more splayed S-shaped configuration than front pivot arm 256, with proximal end 259*a* terminated with a pivot support means 262*b* compatible with opposite pivot support means 262*a*, and angled distal end 259*d* terminated with a swivel assembly 280 and rear caster assembly 232.

Rear pivot arm 258 is provided with rear pivot support means 282. The chassis 212 defines front and rear support means 244 and 248 for pivotally attaching thereto the front pivot arm 256 and a pivot link 284 that is also attached to the rear pivot support means 282. The front support means 244 extends generally downwardly from the base frame 211 and the rear support means extends generally parallel to the base frame 211.

The mid-wheel power drive assembly 216 includes a drive motor 286, a gearbox unit 288 with a laterally extending drive axle 290 (shown with first drive wheel removed in FIG. 5). The gearbox unit 288 is rigidly attached to a face plate 257*d* on front pivot arm 256 through a substantially triangular adaptor bracket 292. It is to be noted that when the motorized base is resting on a planar surface, proximal end of rear pivot arm 258 is axially aligned with proximal end of front pivot arm 256, as well as axially under mid-wheel power drive assembly 216, while the remainder of the rear pivot arm 258 form an outwardly lateral contour path to allow the main body of drive motor 286 to pivot in a vertical plane without interfering with rear pivot arm 258. The drive motor 286 is attached to the rear pivot arm 258.

The general behavior of the present embodiment 200 of the motorized base, traveling on an uneven or irregular surface, offers substantially the same characteristics and advantages as the first embodiment 10 described above. Namely the ability to preserve all wheels in contact with the uneven or irregular ground surface, with chassis 212 maintained in a substantially co-planar position relative to the average ground surface.

Lastly, a common characteristic to all the embodiments of the present invention described above are the substantially rectilinear alignment of the six wheels 20, 22, 29, 31, 33 and 35, on each side of wheelchair bases 10 and 200, which is achieved through the combination of the various structure configurations and angled portions of the front and rear pivot arms.

Furthermore, the front and rear pivot arms 56, 256 and 58, 258 are typically tubular members soldered or molded as individual single piece elements. All structural elements such as the chassis, battery compartment, pivot arms and mounting brackets are preferably made of a rigid and light material such as, for example, aluminum, a light steel alloy, carbon fibre or the like.

Although the above description contains many specificities, these should not be construed as limitations on the scope of the invention but as merely providing one illustration of the presently preferred embodiments of this invention. For example, it would also be within the scope of the present invention to have the motorized base adapted for other uses than wheelchairs such as, for example, to support a stretcher or trolley.

Although the present invention has been described hereinabove by way of preferred embodiments thereof, it can be modified, without departing from the spirit and nature of the subject invention as defined in the appended claims.

What is claimed is:

1. A wheelchair base, said wheelchair base being usable with first and second drive wheels, first end first and second auxiliary wheels and second end first and second auxiliary wheels, said wheelchair base comprising: a base frame; a first pivot arm assembly, said first pivot arm assembly including a first assembly first pivot arm and a first assembly second pivot arm, said first assembly first and second pivot arms being pivotally coupled to each other for pivotal movement about a first assembly transverse pivot axis, said first assembly first and second pivot arms defining respectively first assembly first and second auxiliary wheel attachments substantially opposed to said first assembly transverse pivot axis for attaching respectively said first and second end first auxiliary wheels thereto, said first pivot arm assembly further including a first assembly link pivotally coupled to said first assembly second pivot arm at a location intermediate said first assembly transverse pivot axis and said first assembly second auxiliary wheel attachment for pivotal movement about a first assembly link axis substantially parallel to said first assembly transverse pivot axis, said first pivot arm assembly further defining a first drive wheel attachment at a location intermediate said first assembly first and second auxiliary wheel attachments for attaching said first drive wheel thereto; and a second pivot arm assembly, said second pivot arm assembly including a second assembly first pivot arm and a second assembly second pivot arm, said second assembly first and second pivot arms being pivotally coupled to each other for pivotal movement about a second assembly transverse pivot axis, said second assembly first and second pivot arms defining respectively second assembly first and second auxiliary wheel attachments substantially opposed to said second assembly transverse pivot axis for attaching respectively said first and second end second auxiliary wheels thereto, said second pivot arm assembly further including a second assembly link pivotally coupled to said second assembly second pivot arm at a location intermediate said second assembly transverse pivot axis and said second assembly second auxiliary wheel attachment for pivotal movement about a second assembly link axis substantially parallel to said second assembly transverse pivot axis, said second pivot arm assembly further defining a second drive wheel attachment at a location intermediate said second assembly first and second auxiliary wheel attachments for attaching said second drive wheel thereto; said first and second pivot arm assemblies being mounted to said base frame substantially laterally opposed to each other with said first and second assembly transverse pivot axes substantially parallel to each other; said first and second assembly first pivot arms pivotally coupled to said base frame for pivotal movement respectively about a first and a second assembly first arm axis, said first and second assembly first arm axes being substantially parallel to said first assembly transverse pivot axis; and said first and second assembly links pivotally coupled to said base frame for pivotal movement respectively about a first and a second assembly link-to-frame axis, said first and second assembly link-to-frame axes being substantially parallel to said first assembly transverse pivot axis; said first pivot arm assembly being pivotable relative to said base frame independently of said second pivot arm assembly.

2. A wheelchair base as defined in claim 1, wherein said first assembly link defines a first assembly link length, said first assembly link including a suspension element for allowing variations in said first assembly link length.

3. A wheelchair base as defined in claim 2, wherein said suspension element is configured for biasing said first assembly link towards an equilibrium length.

4. A wheelchair base as defined in claim 2, wherein said suspension element includes a McPherson suspension strut.

5. A wheelchair base as defined in claim 1, wherein said first pivot arm assembly further includes a first assembly reinforcing element operatively coupled to said first assembly second pivot arm and to said base frame for allowing pivotal movements of said first assembly link relative to said first assembly second pivot arm and said base frame.

6. A wheelchair base as defined in claim 5, wherein said first assembly reinforcing element includes a reinforcing element first member pivotally coupled to said base frame; and a reinforcing element second member pivotally coupled to said first assembly second pivot arm and to said reinforcing element first member.

7. A wheelchair base as defined in claim 6, wherein said first assembly reinforcing element and said first assembly link are pivotally coupled to said base frame in a spaced apart relationship relative to each other and said first assembly reinforcing element and said first assembly link are pivotally coupled to said first assembly second pivot arm in a spaced apart relationship relative to each other.

8. A wheelchair base as defined in claim 1, said wheelchair base being usable with a seat assembly mounted to said base frame by an intended user sitting on said seat assembly, said wheelchair base defining a base front end and a base rear end, said first assembly second pivot arm being located rearwardly relative to said first assembly first pivot arm.

9. A wheelchair base as defined in claim 1, further comprising a power drive assembly operatively coupled to said first drive wheel attachment for rotating said first drive wheel relative to said base frame.

10. A wheelchair base as defined in claim 9, wherein said power drive assembly includes a drive motor longitudinally coupled to a gearbox unit, said gear box unit being coupled to said first drive wheel attachment for rotating said first drive wheel relative to said base.

11. A wheelchair base as defined in claim 10, wherein said drive motor is attached to said first assembly first pivot arm.

12. A wheelchair base as defined in claim 10, wherein said drive motor is attached to said first assembly second pivot arm.

13. A wheelchair, said wheelchair comprising: a base frame; a first pivot arm assembly, said first pivot arm assembly including a first assembly first pivot arm and a first assembly second pivot arm, said first assembly first and second pivot arms being pivotally coupled to each other for pivotal movement about a first assembly transverse pivot axis; first and second end first auxiliary wheels mounted respectively to said first assembly first and second pivot arms substantially opposed to said first assembly transverse pivot axis, said first pivot arm assembly further including a first assembly link pivotally coupled to said first assembly second pivot arm at a location intermediate said first assembly transverse pivot axis and said second end first auxiliary wheel for pivotal movement about a first assembly link axis substantially parallel to said first assembly transverse pivot axis; a first drive wheel mounted to said first pivot arm assembly at a location intermediate said first and second end first auxiliary wheels; a second pivot arm assembly, said second pivot arm assembly including a second assembly first pivot arm and a second assembly second pivot arm, said second assembly first and second pivot arms being pivotally coupled to each other for pivotal movement about a second assembly transverse pivot axis; first and second end second auxiliary wheels mounted respectively to said second assembly first and second pivot arms substantially opposed to said second assembly transverse pivot axis, said second pivot arm assembly further including a second assembly link pivotally coupled to said second assembly second pivot arm at a location intermediate said second assembly transverse pivot axis and said second end second auxiliary wheel for pivotal movement about a second assembly link axis substantially parallel to said second assembly transverse pivot axis; and a second drive wheel mounted to said second pivot arm assembly at a location intermediate said first and second end second auxiliary wheels; said first and second pivot arm assemblies being mounted to said base frame substantially laterally opposed to each other with said first and second assembly transverse pivot axes substantially parallel to each other; said first and second assembly first pivot arms pivotally coupled to said frame for pivotal movement respectively about a first and a second assembly first arm axis, said first and second assembly first arm axes being substantially parallel to said first assembly transverse pivot axis; and said first and second assembly links pivotally coupled to said frame for pivotal movement respectively about a first and a second assembly link-to-frame axis, said first and second assembly link-to-frame axes being substantially parallel to said first assembly transverse pivot axis; said first pivot arm assembly being pivotable relative to said base frame independently of said second pivot arm assembly.

14. A wheelchair as defined in claim 13, further comprising a seat assembly mounted to said base frame.

15. A wheelchair as defined in claim 14, further comprising a power drive assembly operatively coupled to said first pivot arm assembly and to said first drive wheel for rotating said first drive wheel relative to said base frame to propel said wheelchair.

16. A wheelchair as defined in claim 14, further comprising a pair of power drive assemblies each operatively coupled to a respective one of said first and second pivot arm assemblies and to a respective one of said first and second drive wheels for rotating respectively said first and second drive wheels relative to said base frame to propel said wheelchair.

* * * * *